US012638255B2

(12) United States Patent
Chen et al.

(10) Patent No.: US 12,638,255 B2
(45) Date of Patent: May 26, 2026

(54) RADIATION HEAT DISSIPATION SUBSTRATE, RADIATIVE COOLING DEVICE CONTAINING THE SAME AND PREPARATION METHOD THEREOF

(71) Applicant: National Tsing Hua University, Hsinchu (TW)

(72) Inventors: Yu-Bin Chen, Hsinchu (TW); Chih-Chan Chiang, Hsinchu (TW); Jui-Yung Chang, Hsinchu (TW); Cheng-Yang Liu, Hsinchu (TW); Chien-Hao Liu, Hsinchu (TW)

(73) Assignee: National Tsing Hua University, Hsinchu (TW)

( * ) Notice: Subject to any disclaimer, the term of this patent is extended or adjusted under 35 U.S.C. 154(b) by 208 days.

(21) Appl. No.: 18/401,783

(22) Filed: Jan. 2, 2024

(65) Prior Publication Data

US 2025/0155206 A1 May 15, 2025

(30) Foreign Application Priority Data

Nov. 9, 2023 (TW) ..... 112143243

(51) Int. Cl.
*F28F 13/18* (2006.01)
*C25D 13/04* (2006.01)
*C25D 13/12* (2006.01)

(52) U.S. Cl.
CPC ..... *F28F 13/18* (2013.01); *C25D 13/04* (2013.01); *C25D 13/12* (2013.01)

(58) Field of Classification Search
CPC ..... F28F 13/18
See application file for complete search history.

(56) References Cited

U.S. PATENT DOCUMENTS

| | | | | |
|---|---|---|---|---|
| 9,927,188 | B2 * | 3/2018 | Liu | F28F 3/00 |
| 2004/0048541 | A1 * | 3/2004 | Offord | D06M 15/11 442/364 |
| 2004/0234887 | A1 * | 11/2004 | Leon | B41C 1/1025 430/954 |
| 2006/0099364 | A1 * | 5/2006 | Harrison | B65D 1/0207 428/35.7 |
| 2008/0090169 | A1 * | 4/2008 | Eveson | B41M 5/426 264/131 |
| 2009/0047597 | A1 * | 2/2009 | Felder | B41M 5/46 427/145 |
| 2010/0216211 | A1 * | 8/2010 | Shauer | D01F 11/00 428/221 |
| 2020/0131660 | A1 * | 4/2020 | Chen | C25D 13/22 |

FOREIGN PATENT DOCUMENTS

| | | | | |
|---|---|---|---|---|
| KR | 20220074101 A | * | 6/2022 | F25B 23/003 |

* cited by examiner

*Primary Examiner* — Devon Lane

(57) ABSTRACT

Provided is a radiative cooling substrate, sequentially composed of a broadband radiation absorption layer, a metal substrate, and a wavelength-selective infrared emission layer. Also provided is a method for preparing the aforementioned radiative cooling substrate, which simply involves placing the metal substrate into an electrophoresis tank and depositing the broadband radiation absorption layer and the wavelength-selective infrared emission layer on the two sides of the metal substrate, respectively. Additionally, a radiative cooling device, comprising the above-mentioned radiative cooling substrate, is also provided.

4 Claims, 4 Drawing Sheets

RADIATION HEAT DISSIPATION SUBSTRATE, RADIATIVE COOLING DEVICE CONTAINING THE SAME AND PREPARATION METHOD THEREOF

CROSS-REFERENCE TO RELATED APPLICATION

This application claims the priority benefit of Taiwan application serial no. 112143243, filed Nov. 9, 2023, the full disclosure of which is incorporated herein by reference.

BACKGROUND

Technical Field

The disclosure relates to a radiative cooling substrate and its preparation method, particularly relates to a radiative cooling substrate with a Janus structure and its preparation method.

Description of Related Art

Traditional radiative cooling devices only consider the thermal radiation emissivity towards the external side. However, when a radiative cooling device is applied to an enclosure, the nature of radiation, either emission or absorption, towards the inner side of the enclosure also needs to be taken into consideration. This is because the radiation properties on both sides will affect the heat dissipation efficiency.

SUMMARY

To address the aforementioned issues, one aspect of the disclosure is to provide a radiative cooling substrate with a Janus structure, featuring thin films on both sides with different thermal radiation properties.

The radiative cooling substrate comprises a metal substrate, a broadband radiation absorption layer, and a wavelength-selective infrared emission layer. The metal substrate has a first surface and a second surface in opposite. The broadband radiation absorption layer is located on the first surface of the metal substrate. The broadband radiation absorption layer is located on the first surface of the metal substrate.

In an embodiment of this disclosure, the broadband radiation absorption layer has high absorptance for the entire infrared light range, and the wavelength-selective infrared emission layer has high emittance for infrared light within the atmospheric window band (mainly 8-13 μm).

In another embodiment of this disclosure, the broadband radiation absorption layer is a chitosan carbon black layer without other layers.

In still another embodiment of this disclosure, the metal substrate is a stainless-steel substrate without other layers.

In still another embodiment of this disclosure, the wavelength-selective infrared emission layer is a chitosan layer without other layers.

Another aspect of this disclosure is to provide a radiative cooling device comprises the aforementioned radiative cooling substrate.

Still another aspect of this disclosure is to provide a method of preparing a radiative cooling substrate. The method comprises the following steps. A chitosan solution and a chitosan carbon black solution are prepared. A metal substrate is placed in an electrophoresis tank, wherein the metal substrate has a first surface and a second surface in opposite. The chitosan carbon black solution is poured into an electrophoresis tank. Electrophoresis is performed to deposit a chitosan carbon black layer on the first surface of the metal substrate. The electrophoresis tank of the chitosan carbon black solution is emptied. The chitosan solution is poured into the electrophoresis tank. Electrophoresis is performed to deposit a chitosan layer on the second surface of the metal substrate to form a radiative cooling substrate with a three-layer structure.

In an embodiment of this disclosure, the electrophoresis is performed under conditions comprising an applied voltage of 20-30 V and an electrification time of 2-5 minutes.

In another embodiment of this disclosure, the solvent of the chitosan solution comprises acetic acid, water, and alcohol in a volume ratio of 1:100:400.

In another embodiment of this disclosure, the method of preparing the chitosan carbon black solution comprises adding 0.1-0.3 g of carbon black powder to every 250 mL of chitosan solution.

As described above, the radiative cooling substrate of this disclosure has a simple structure, requiring the formation of thin films with different thermal radiation properties on both sides of the metal substrate (specifically, the broadband radiation absorption layer and the wavelength-selective infrared emission layer). Therefore, the radiative cooling substrate of this disclosure allows the absorption of thermal radiation by the broadband radiation absorption layer on one side of the metal substrate. The absorbed heat is then conducted through the metal substrate with high thermal conductivity, and the release of thermal radiation is efficiently managed by the wavelength-selective infrared emission layer on the other side of the metal substrate. Consequently, any radiative cooling device using the radiative cooling substrate of this disclosure can significantly improve the efficiency of heat dissipation.

Moreover, the preparation method for the radiative cooling substrate provided by this disclosure is straightforward, requiring only a set of electrophoresis equipment, enabling the efficient and rapid preparation of the radiative cooling substrate in a short period.

DETAILED DESCRIPTION

The detailed description provided below in connection with the appended drawings is intended as a description of the present examples and is not intended to represent the only forms in which the present example may be constructed or utilized. The description sets forth the functions of the example and the sequence of steps for constructing and operating the example. However, the same or equivalent functions and sequences may be accomplished by different examples.

Radiative Cooling Substrate

As mentioned above, the embodiments of this disclosure provide a radiative cooling substrate composed sequentially of a broadband radiation absorption layer, a metal substrate, and a wavelength-selective infrared emission layer to give a Janus structure. The Janus structure refers to a configuration where both sides of the substrate have different thermal radiation properties, enabling thermal energy transfer from one side of the substrate to the other.

Figure 1:
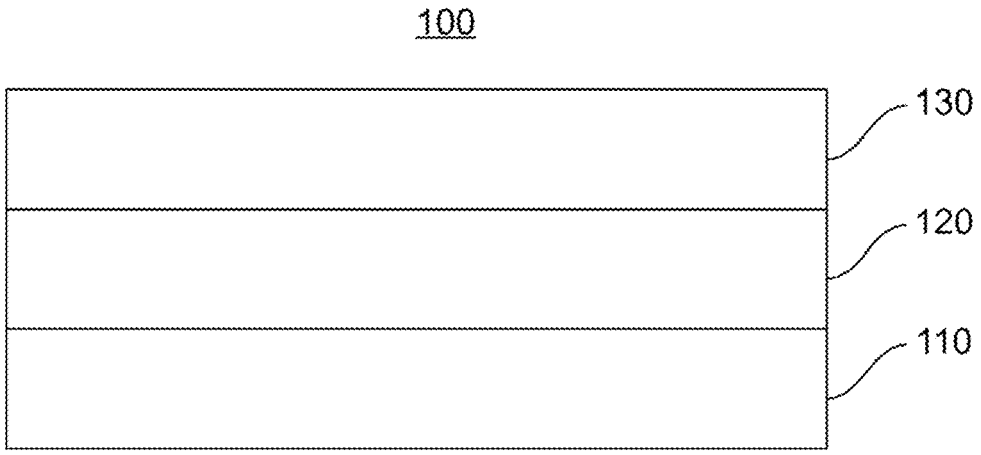
FIG. 1 is a schematic cross-sectional view of a radiative cooling substrate according to one embodiment of this disclosure.

FIG. 1 is a schematic cross-sectional view of a radiative cooling substrate according to one embodiment of this disclosure. In FIG. 1, the radiative cooling substrate 100 is composed sequentially of a broadband radiation absorption layer 110, a metal substrate 120, and a wavelength-selective infrared emission layer 130. Specifically, the metal substrate 120 has first and second surfaces in opposite. The broadband radiation absorption layer 110 is located on the first surface of the metal substrate 120, while the wavelength-selective infrared emission layer 130 is located on the second surface of the metal substrate 120.

In the radiative cooling substrate 100, the thin film on one side of the metal substrate 120 is the broadband radiation absorption layer 110, capable of absorbing thermal radiation across all wavelengths. On the other side of the metal substrate 120 is the wavelength-selective infrared emission layer 130, capable of emitting thermal radiation in specific wavelength bands. With the high thermal conductivity of the metal substrate 120, the efficiency of transferring radiant heat from the side of the broadband radiation absorption layer 110 to the side of the wavelength-selective infrared emission layer 130 is further enhanced.

In one embodiment of this disclosure, the broadband radiation absorption layer 110 has high absorptance (e.g., greater than 0.8) for the broad infrared thermal radiation band. The wavelength-selective infrared emission layer 130 has high emittance (e.g., greater than 0.7) for certain infrared radiation within the atmospheric window band (8-13 μm). This enhances the efficiency of heat transfer for the radiative cooling substrate 100. The reason is that the Earth's atmosphere absorbs most of the long-wave infrared radiation (i.e., thermal radiation), making it challenging for objects to dissipate heat. However, the mentioned atmospheric window band of infrared radiation is an exception. In this band, infrared radiation is not absorbed by the Earth's atmosphere but instead directly passes through the Earth's atmosphere into space. Therefore, if the broadband radiation absorption layer 110 can absorb the infrared thermal radiation released by the target object (the object to be cooled), and the wavelength-selective infrared emission layer 130 can radiate the heat concentrated in the atmospheric window band out into space without being blocked by the Earth's atmosphere. Hence, the efficiency of heat transfer for the radiative cooling substrate 100 can be enhanced.

In one embodiment of this disclosure, the metal substrate 120 may be, for example, a stainless-steel substrate, but is not limited thereto. In one embodiment of this disclosure, the broadband radiation absorption layer 110 may be, for example, a chitosan carbon black layer, but is not limited thereto this material. In one embodiment of this disclosure, the wavelength-selective infrared emission layer 130 may be, for example, a chitosan layer, but is not limited thereto. Any other suitable materials can be used for the broadband radiation absorption layer 110, metal substrate 120, and wavelength-selective infrared emission layer 130, respectively.

Radiative Cooling Device

Additionally, this disclosure provides a radiative cooling device that comprises the aforementioned radiative cooling substrate 100. The radiative cooling device may be applied in outdoor settings such as metal pipelines, transportation vehicles, metal storage tanks, and metal roofs.

When the purpose of using the radiative cooling substrate 100 is to lower the temperature, the broadband radiation absorption layer 110 is positioned on the side of the metal substrate 120 facing the target object, towards the inside of the radiative cooling device. Moreover, the wavelength-selective infrared emission layer 130 is positioned on the side of the metal substrate 120 facing the outside of the radiative cooling device. This arrangement allows the absorbed thermal radiation on the inside of the radiative cooling device to be effectively dissipated outward.

Method of Preparing Radiative Cooling Substrate

Furthermore, a method for preparing the radiative cooling substrate is provided. The method requires only the placement of the metal substrate into an electrophoresis tank to deposit the broadband radiation absorption layer and the wavelength-selective infrared emission layer on both sides of the metal substrate. Please refer to FIG. 2, which is a process flowchart illustrating the preparation of a radiative cooling substrate according to one embodiment of this disclosure.

Figure 2:
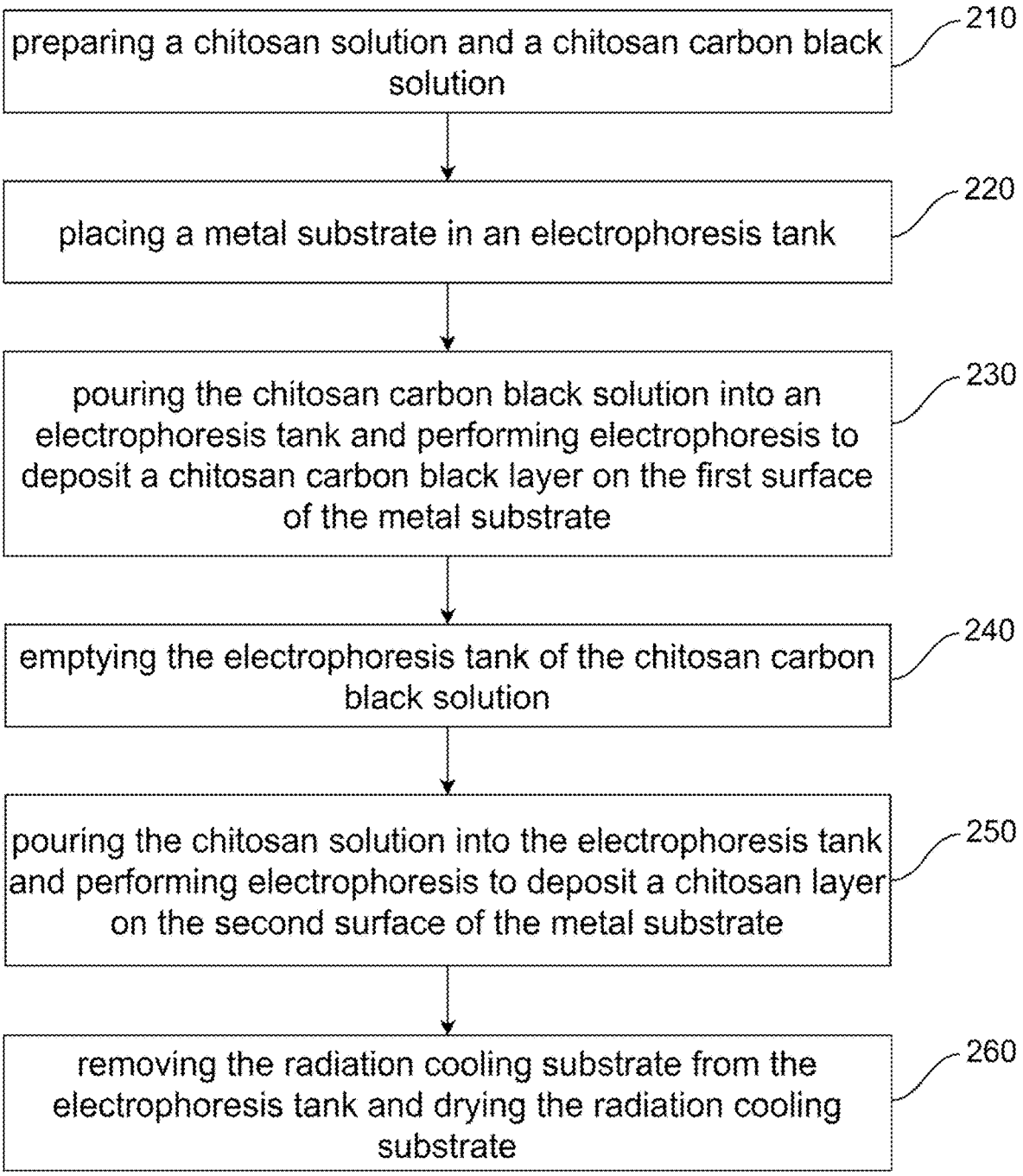
FIG. 2 is a process flowchart illustrating the preparation of a radiative cooling substrate according to one embodiment of this disclosure.

In Step 210 of FIG. 2, a chitosan solution and a chitosan carbon black solution are prepared. The solvent for the chitosan solution comprises acetic acid, water, and alcohol in a volume ratio of 1:100:400.

The method of preparing the chitosan solution is as follows. Chitosan powder, ranging from 0.2 to 0.4 grams (e.g., 0.2 grams, 0.3 grams, or 0.4 grams), is added to 100 mL of deionized water and stirred. 1 mL of acetic acid is added, and stirring is continued to dissolve the chitosan powder. Subsequently, the mixture is uniformly blended with 400 mL of alcohol to obtain the chitosan solution. Finally, the chitosan solution is subjected to ultrasonic oscillation to remove gases from the chitosan solution for subsequent use.

The method of preparing the chitosan carbon black solution is as follows. 0.1 to 0.3 grams (e.g., 0.1 grams, 0.2 grams, or 0.3 grams) of carbon black powder is added to the previously prepared 250 mL chitosan solution and stirred evenly to obtain the chitosan carbon black solution. The chitosan carbon black solution is subjected to ultrasonic oscillation to remove gases from the chitosan carbon black solution for subsequent use.

In Step 220, the metal substrate 120 and another metal plate are placed on opposite sides of the electrophoresis tank. Subsequently, the metal substrate 120 is connected to the cathode of the DC power supply, while the other metal plate is connected to the anode of the DC power supply. The metal substrate 120 has opposite first and second surfaces, and its thickness of the metal substrate 120 may be 0.5-2 mm, for example.

In Step 230, the previously prepared chitosan carbon black solution is poured into the electrophoresis tank to perform electrophoresis. In the electrophoresis process, a chitosan carbon black layer is deposited on the first surface of the metal substrate 120, serving as the broadband radiation absorption layer 110. During the electrophoresis process, the voltage of the DC power supply is maintained at 20-30 V, such as 20, 21, 22, 23, 24, 25, 26, 27, 28, 29, or 30 V. The electrification time can be 2-5 minutes, such as 2, 3, 4, or 5 minutes.

In Step 240, the chitosan carbon black solution in the electrophoresis tank is emptied.

In Step 250, the metal substrate 120 is taken out, flipped, and then placed back into the electrophoresis tank. The chitosan solution is poured into the electrophoresis tank, and electrophoresis is performed to deposit a chitosan layer on the second surface of the metal substrate 120, serving as the wavelength-selective infrared emission layer 130. At this point, a radiative cooling substrate 100 with a three-layer structure has been formed.

Finally, in Step 260, the radiative cooling substrate 100 is removed from the electrophoresis tank and is ready for use after being dried.

Experimental Examples of Radiative Cooling Substrate

Figure 3A:
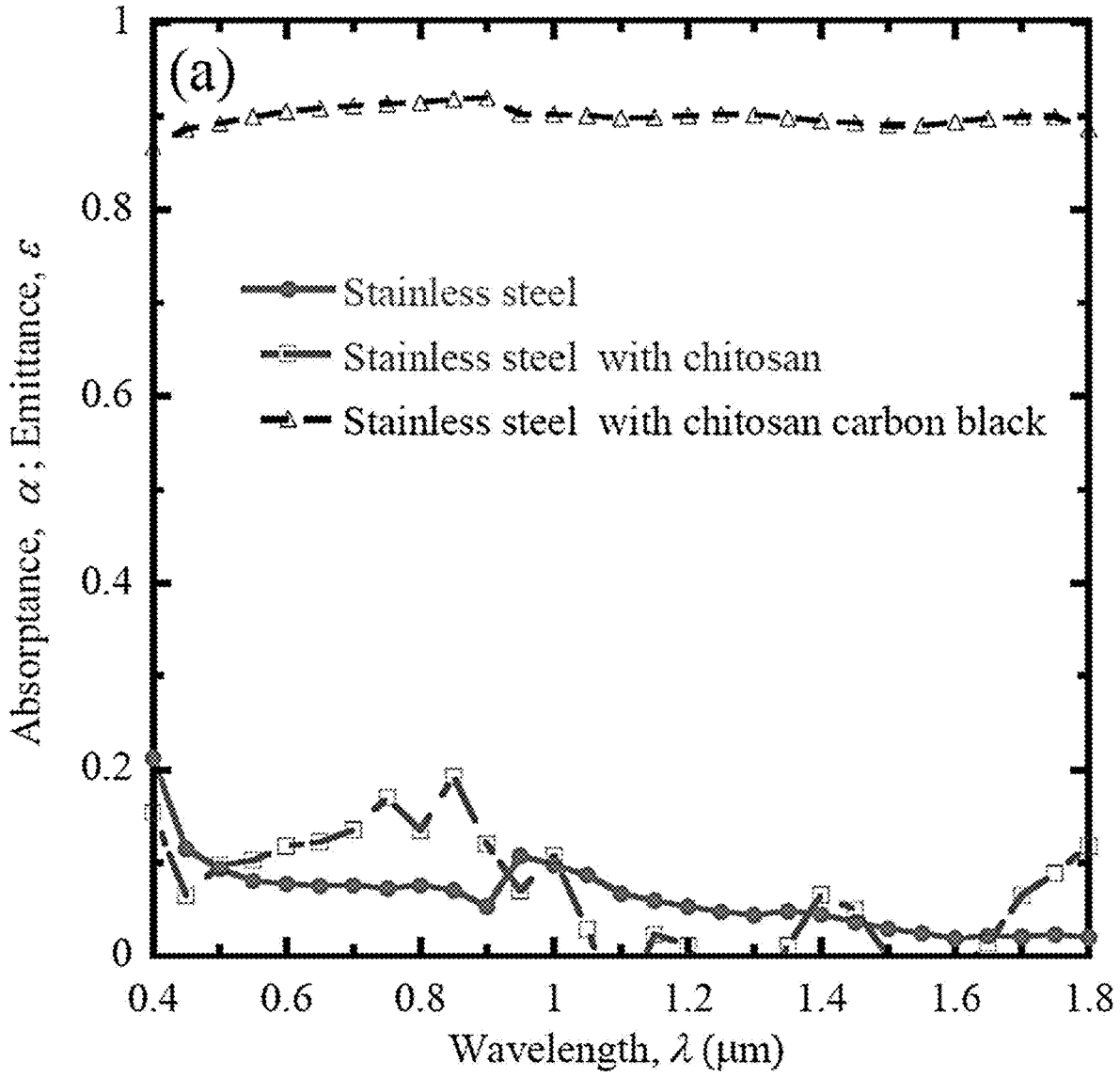
FIGS. 3A-3B show absorption/emission spectra of thermal radiation for a radiative cooling substrate according to one embodiment of this disclosure, where FIG. 3A displays the short wavelength range of 0.4-1.8 μm, and FIG. 3B displays the long wavelength range of 2-12 μm.
Figure 3B:
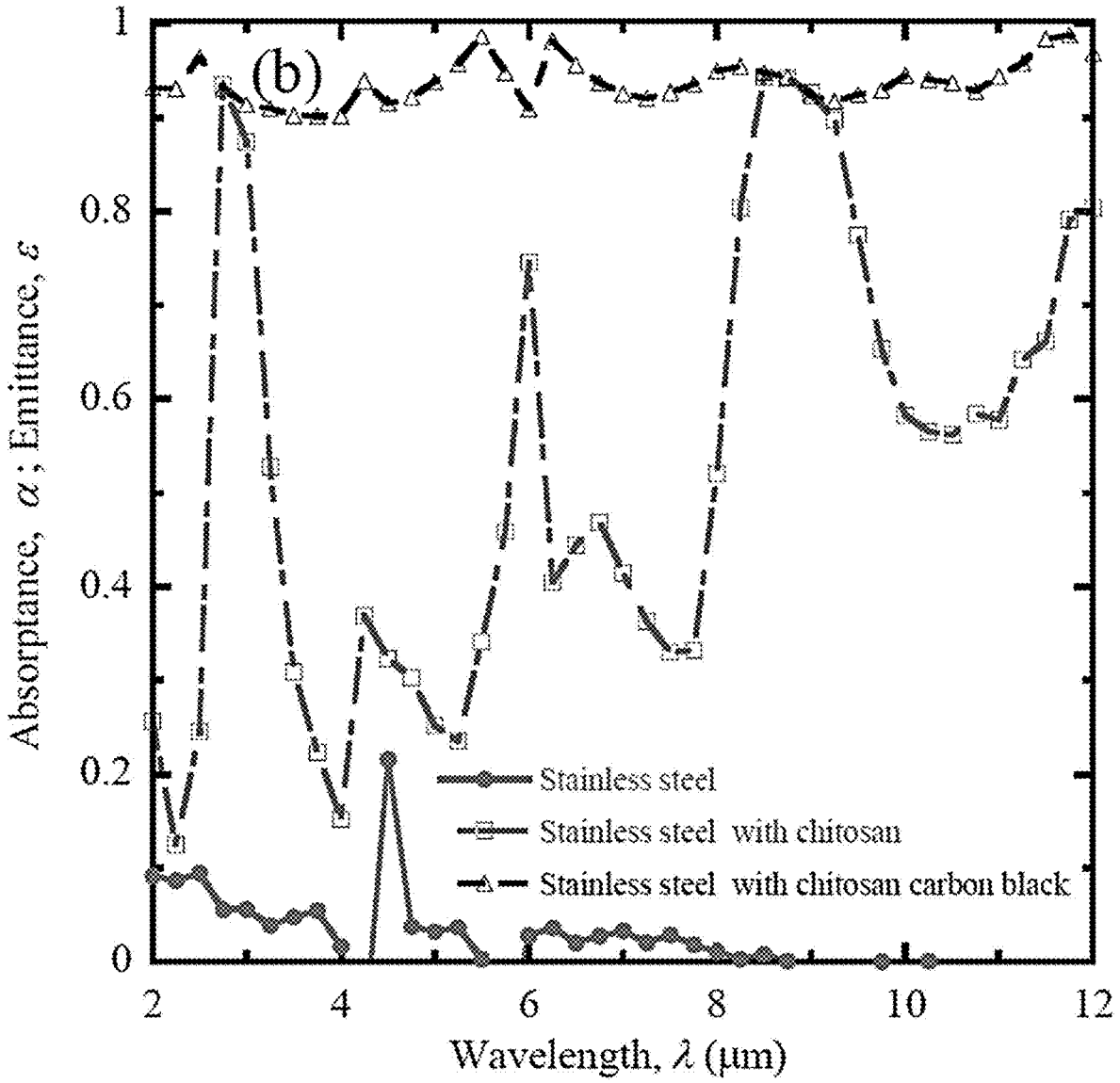

In accordance with the above, a radiative cooling substrate is prepared, and absorption/emission spectra for thermal radiation are tested. The absorption/emission spectra for thermal radiation of the radiative cooling substrate are obtained, as shown in FIGS. 3A-3B. FIGS. 3A-3B show absorption/emission spectra of thermal radiation for a radiative cooling substrate according to one embodiment of this disclosure, where FIG. 3A displays the short wavelength range of 0.4-1.8 μm, and FIG. 3B displays the long wavelength range of 2-12 μm.

In this experiment, in Step 210 of the aforementioned preparation method, the addition amount of chitosan in the chitosan solution is 0.3 grams, and the addition amount of the carbon black in the chitosan carbon black solution is 0.2 grams. The metal substrate is made of 304 stainless steel, with dimensions of 50 mm×38 mm and a thickness of 1 mm. Both sides of the stainless steel substrate undergo a bright surface treatment. The voltage for the electrophoresis process is set at 25 V, and the electrification time is 3 minutes.

In FIG. 3A, the visible light and thermal radiation absorptance of the uncoated stainless steel substrate are extremely low, with absorptance mostly below 0.2. The chitosan film serving as the wavelength-selective infrared emission layer in the Janus structure also exhibits absorptance for visible light and thermal radiation mostly below 0.2. Hence, a low absorptance in both the visible light and near-infrared light ranges is achieved. On the other hand, the chitosan carbon black film acting as the broadband radiation absorption layer in the Janus structure shows an absorptance of about 0.9 for both visible light and thermal radiation, presenting a broadband high absorptance across the entire spectrum in FIG. 3A.

In FIG. 3B, the thermal radiation absorptance of the uncoated stainless steel is extremely low, with absorptance mostly below 0.1. The chitosan film serving as the wavelength-selective infrared emission layer in the Janus structure exhibits three distinct radiation peaks in the thermal radiation emission spectrum, appearing at wavelengths of 2.25-3.5 μm, 5.5-6.25 μm, and 8-10 μm. The radiation peak at 8-10 μm is situated in the atmospheric window (8-13 μm), and the effect of selectively radiating in the atmospheric window is thus achieved. On the other hand, the chitosan carbon black film acting as the broadband radiation absorption layer in the Janus structure shows a thermal radiation absorptance of about 0.9, presenting a broadband high absorptance across the entire spectrum in FIG. 3B.

As evident from the above, the radiative cooling substrate of this disclosure has a simple structure, requiring the formation of films with different thermal radiation properties on both sides of the metal substrate (i.e., the broadband radiation absorption layer and the wavelength-selective infrared emission layer). Therefore, the radiative cooling substrate of this disclosure can have the side of the metal substrate with the broadband radiation absorption layer responsible for absorbing thermal radiation, passing through the thermally conductive metal substrate, and then having the side of the metal substrate with the wavelength-selective infrared emission layer responsible for concentrating the absorbed thermal radiation in the atmospheric window to effectively release the thermal radiation into outer space. Consequently, any radiative cooling device using the radiative cooling substrate of this disclosure can significantly enhance the efficiency of heat dissipation.

Furthermore, the method for preparing the radiative cooling substrate provided by this disclosure is straightforward, requiring only the use of an electrophoresis apparatus to allow the preparation of the radiative cooling substrate to be completed in a short time.

While this invention has been disclosed in the above embodiments, it is not intended to limit the scope of the invention. Those skilled in the art may make various modifications and refinements within the spirit and scope of the invention. Therefore, the protection scope of this disclosure should be determined based on the appended claims in the subsequent patent application.

What is claimed is:

1. A radiative cooling substrate, comprising:

a metal substrate having a first surface and a second surface in opposite, wherein the metal substrate is a stainless-steel substrate without other layers;

a broadband radiation absorption layer located on the first surface of the metal substrate, wherein the broadband radiation absorption layer is a chitosan carbon black layer without other layers, and the chitosan carbon black layer is electrophoresis deposited from a chitosan carbon black solution prepared by adding 0.1-0.3 g of carbon black powder to every 250 mL of chitosan solution; and a wavelength-selective infrared emission layer located on the second surface of the metal substrate, wherein the wavelength-selective infrared emission layer is a chitosan layer without other layers.

2. The radiative cooling substrate of claim 1, wherein the broadband radiation absorption layer has high absorptance for the entire infrared light range, and the wavelength-selective infrared emission layer has high emittance for infrared light within the atmospheric window band.

3. A radiative cooling device, comprising the radiative cooling substrate of claim 1.

4. The radiative cooling device of claim 3, wherein the broadband radiation absorption layer has high absorptance for the entire infrared light range, and the wavelength-selective infrared emission layer has high emittance for infrared light within the atmospheric window band.

* * * * *